US005761574A

United States Patent [19]

Murooka

[11] Patent Number: 5,761,574

[45] Date of Patent: Jun. 2, 1998

[54] IMAGE FORMING APPARATUS

[75] Inventor: Ken Murooka, Boise, Id.

[73] Assignee: Canon Kabushiki Kaisha, Tokyo, Japan

[21] Appl. No.: 842,273

[22] Filed: Apr. 24, 1997

[30] Foreign Application Priority Data

May 1, 1996 [JP] Japan ..... 8-132566

[51] Int. Cl.[6] ..... G03G 15/00

[52] U.S. Cl. ..... 399/66; 399/181

[58] Field of Search ..... 399/181, 82, 85, 399/66, 46; 347/139, 153, 154, 131

[56] References Cited

U.S. PATENT DOCUMENTS 5,621,451 4/1997 Suguira et al. ..... 347/112

*Primary Examiner*—Arthur T. Grimley
*Assistant Examiner*—Quana Grainger
*Attorney, Agent, or Firm*—Fitzpatrick, Cella, Harper & Scinto

[57] ABSTRACT

An image forming apparatus includes an image bearing member for bearing a toner image, and a transfer member for transferring the toner image from the image bearing member onto a transfer material at a transfer position. The transfer member contacts a surface of the transfer material opposite to a surface facing the image bearing member so as to press the transfer material against the image bearing member. The apparatus is capable of selecting one of a first mode of forming a character image on the transfer material and a second mode of forming a halftone image on the transfer material. The apparatus also includes a changing unit for changing a speed ratio of a conveying speed of the transfer material at the transfer position to a circumferential speed of the image bearing member in accordance with a mode selected from among the first mode and the second mode.

11 Claims, 3 Drawing Sheets

IMAGE FORMING APPARATUS

BACKGROUND OF THE INVENTION

1. Field of the Invention

This invention relates to an image forming apparatus, such as an electrostatic copier, a printer or the like.

2. Description of the Related Art

In well-known image forming apparatuses including apparatus that form a toner image by providing an electrostatic latent image formed on an image bearing member with a toner and transferring the obtained toner image onto a transfer material, such as paper or the like, an approach of using a transfer roller contacting the image bearing member as transfer means in a transfer process has been frequently adopted.

A typical example of such an image forming apparatus will now be briefly described with reference to FIGS. 4 and 5. FIG. 4 is a schematic side cross-sectional view illustrating a laser-beam printer serving as an image forming apparatus. A cylindrical image bearing member 6 which has an axis in a direction perpendicular to the cross-sectional plane of FIG. 4 and which rotates in a direction indicated by an arrow is disposed within a main body A of the printer.

A photoconductive layer is formed on the surface of the image bearing member 6. The photoconductive layer is uniformly charged by a charging roller 2, serving as primary charging means. A laser beam L modulated by an object image is projected from a scanner 10 onto the charged surface of the photoconductive layer via a mirror 11 to form an electrostatic latent image on the surface of the image bearing member 6.

When the latent image reaches a developing portion, where a developing unit 13 is disposed so as to face the latent image, as a result of rotation of the image bearing member 6, a toner is supplied from the developing unit 13 to form a toner image. When the toner image reaches a transfer portion where a transfer roller 14 is disposed so as to contact the image bearing member 6, a transfer material P within a cassette C is supplied to the transfer portion in synchronization with the toner image on the image bearing member 6. At the same time, a transfer bias voltage is applied to the transfer roller 14, so that the toner image on the image bearing member 6 is transferred onto the transfer material P due to the function of an electric field formed by the transfer bias voltage.

The transfer material P bearing the toner image transferred at the transfer portion is separated from the image bearing member 6, and then reaches a fixing portion, where a fixing roller 15 and a pressing roller 15' in contact therewith are provided, via a conveying path G-c, and the toner image is fixed on the transfer material P by being heated and pressed while passing through a pressing nip portion formed between the two rollers.

A hard copy thus obtained is discharged to the outside of the apparatus via a conveying path G-d, a pair of discharging rollers 16 and 16', and a conveying path G-e. Toner particles which have not been transferred onto the transfer material P at the transfer portion are removed by a cleaner 8, and the image bearing member 6 assumes a state capable of performing the next image forming process.

The surrounding structure of the transfer roller 14 of the above-described image forming appartus will now be described with reference to FIG. 5. The transfer roller 14 contacting the image bearing member 6 has a shaft 12, and a gear **14-*a* is provided at one extruded end of the shaft 12**.

A gear **6-*a* for driving the image bearing member 6 by being connected to a driving-side gear train (not shown), and a gear 6-*b* present in the proximity of the the gear 6-*a* are provided at an end of the image bearing member 6. The gear 14-*a* engages with the gear 6-*b*. Accordingly, the transfer roller 14 is driven by the gear 6-*a* via the gears 6-*b* and 14-*a***.

In such a configuration, the gear ratio of the gear **6-*b* to the gear 14-*a* is set so that the outer circumferential speed of the transfer roller 14 at the transfer position is slightly greater than the outer circumferential speed of the image bearing member 6. According to this configuration, the toner image is scraped off from the image bearing member 6** onto the transfer material P during image transfer, so that a so-called "central void" phenomenon, in which only peripheral portions are transferred but a central portion is not transferred when transferring lines, characters and the like, is prevented.

Recently, in accordance with improvement in the performance of host computers, it is often requested for such a printer to print photographs, graphics and the like as well as characters and lines, and there is an increasing request from the user to remove uneveness in the density of halftone portions.

However, if it is intended to prevent a central void by providing a difference between the circumferential speed of the transfer roller and the circumferential speed of the image bearing member as described above, uneveness in the density of halftone portions becomes more pronounced.

SUMMARY OF THE INVENTION

It is an object of the present invention to prevent a central void in an image including characters and lines and also to prevent the generation of unevenness in the density of a halftone image, such as a photograph or the like, in an image forming apparatus in which a transfer material is brought in pressure contact with an image bearing member.

According to one aspect, the present invention which achieves the above-described object relates to an image forming apparatus including an image bearing member for bearing a toner image, and a transfer member for transferring the toner image from the image bearing member onto a transfer material at a transfer position. The trasfer member contacts a surface of the transfer material opposite to a surface facing the image bearing member so as to press the transfer material against the image bearing member. The apparatus is capable of selecting one of a first mode of forming a character image on the transfer material and a second mode of forming a halftone image on the transfer material. The apparatus also includes a changing unit for changing a speed ratio of a conveying speed of the transfer material at the transfer position to a circumferential speed of the image bearing member in accordance with a mode selected from among the first mode and the second mode.

The foregoing and other objects, advantages and features of the present invention will become more apparent from the following detailed description of the preferred embodiments taken in conjunction with the accompanying drawings.

DETAILED DESCRIPTION OF THE PREFERRED EMBODIMENTS

Preferred embodiments of the present invention will now be described with reference to the drawings.

Figure 1:
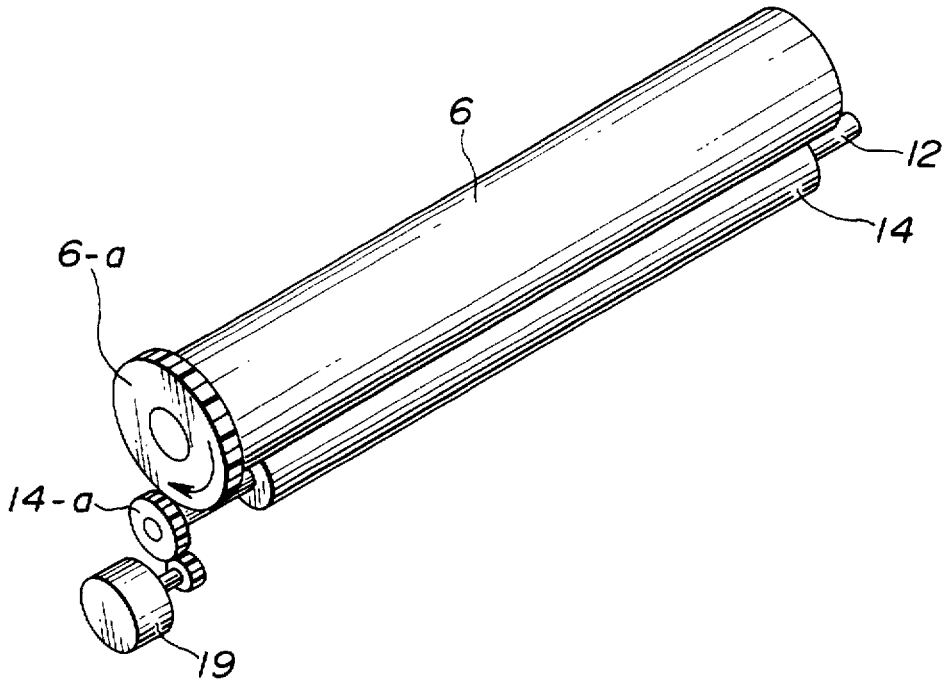
FIG. 1 is a perspective view of a principal portion of an image forming apparatus according to a first embodiment of the present invention, particularly illustrating an image bearing member and a transfer roller in contact therewith, and the driving mechanism between the two members.
Figure 4:
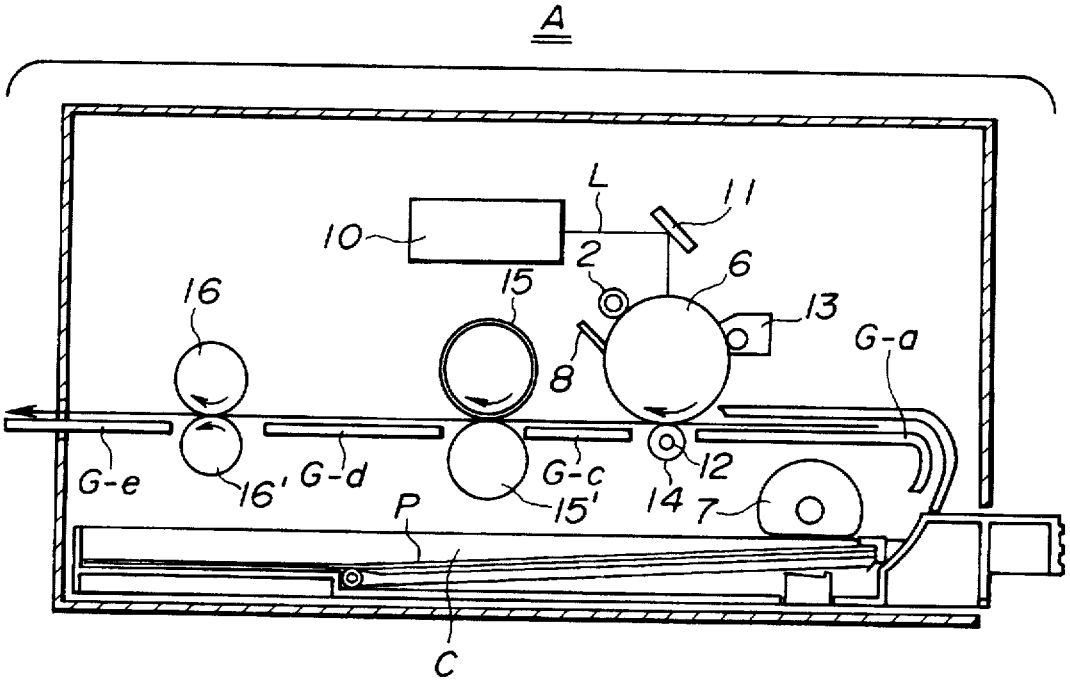
FIG. 4 is a schematic cross-sectional view illustrating the configuration of a known image forming apparatus.
Figure 5:
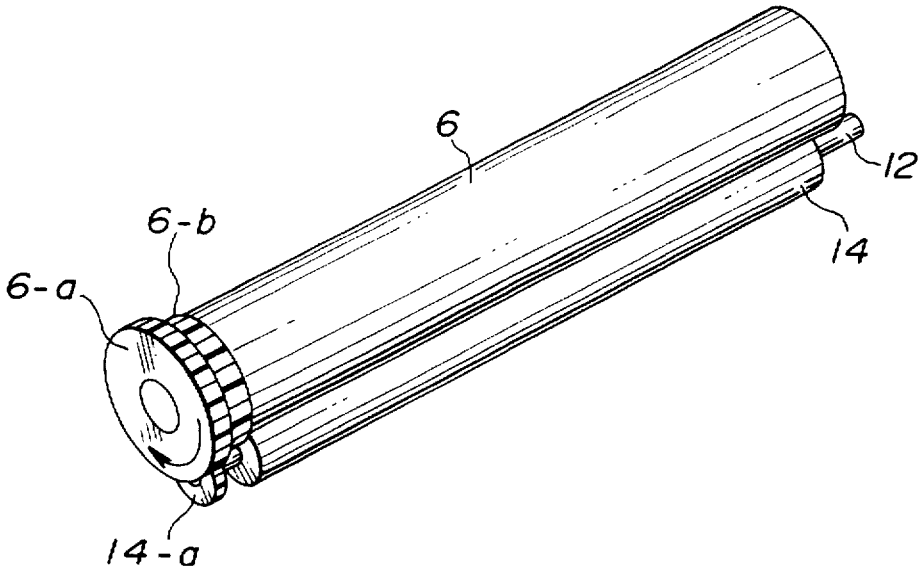
FIG. 5 is a perspective view of a principal portion of the apparatus shown in FIG. 4 illustrating arrangement of an image bearing member and a transfer roller in contact therewith.

FIG. 1 illustrates only the surrounding structure of a transfer roller of an image forming apparatus according to a first embodiment of the present invention. Since the main body of this image forming apparatus where the transfer roller is mounted is basically the same as that shown in FIG. 4, a description thereof will be omitted.

An elastic sponge layer is formed on the surface of a transfer roller 14, and a voltage having a polarity opposite to that of a toner is applied to a shaft 12 of the transfer roller 14 during image transfer.

A gear 14-*a* is disposed at one protruded end of the shaft 12 of the transfer roller 14 contacting an image bearing member 6. The gear 14-*a* is connected so as to be driven by a stepping motor 19 provided separately from a driving source for the image bearing member 6. Although omitted in FIG. 1, the driving source for the image bearing member 6 drives a gear 6-*a*.

The stepping motor 19 changes its revolution speed by being switched between a halftone-image mode for graphics, a photograph or the like and a character-image mode by a signal to the main body of the image forming apparatus through a mode selection button or the like operated by the user, or a signal from a host computer to the main body of the image forming apparatus.

For example, when outputting an image including only characters and lines, the character-image mode is selected, in which the speed of the stepping motor 19 is set so that the circumferential speed of the transfer roller 14 at a transfer position (nip position) is greater than that of the image bearing member 6, for example, 101% of the circumferential speed of the image bearing member 6, in order to prevent the occurrence of a central void. When outputting graphics, a photograph or the like, the halftone-image mode is selected, in which the speed of the stepping motor 19 is set so that the circumferential speed of the transfer roller 14 at the transfer position substantially coincides with that of the image bearing member 6, in order to improve unevenness in the density of the obtained image.

Since the transfer roller 14 is driven by the stepping motor 19, its revolution speed can be steplessly adjusted within a certain range. Graphics, photographs and the like generally have a larger amount of data than characters, lines and the like. Hence, it is also possible to automatically change the rotation speed of the transer roller 14 in accordance with the amount of data transmitted to the printer (image forming apparatus). That is, when the amount of data is larger than a predetemined value, the image represented by the data may be recognized as a halftone image, and when the amount of data is smaller than the predetermined value, the image represented by the data may be recognized as a character image, and the circumferential speed of the transfer roller 14 may be determined for each type of image.

As described above, by changing the speed ratio of the conveying speed of the transfer material at the transfer position to the circumferential speed of the image bearing member depending on whether the selected mode is a mode for forming a character image or a mode for forming a halftone image, it is possible to prevent a central void in a character image and also to prevent unevenness in the density of a halftone image.

Figure 2:
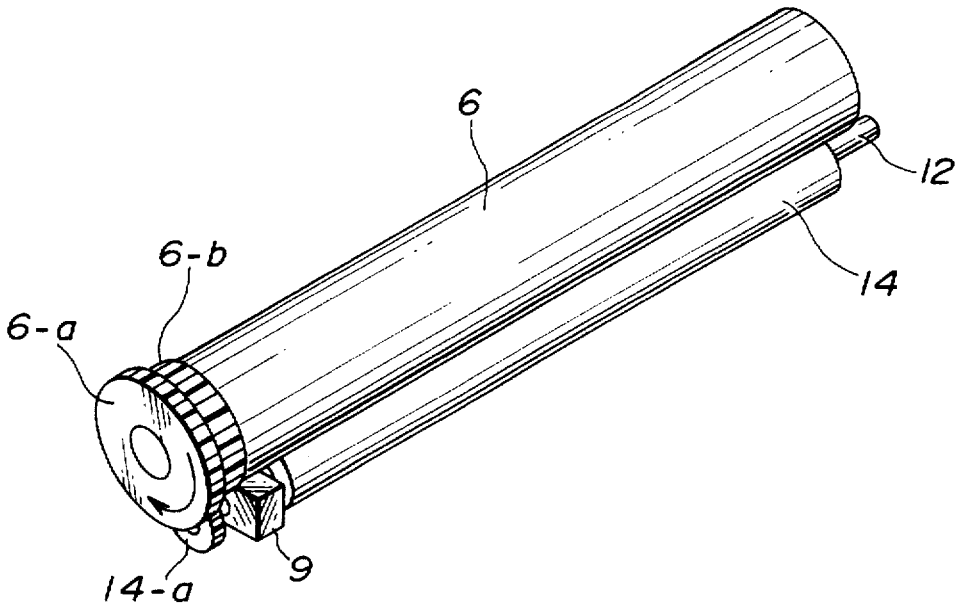
FIG. 2 is a perspective view of a principal portion of an image forming apparatus according to a second embodiment of the present invention, particularly illustrating an image bearing member and a transfer roller in contact therewith, and the driving mechanism between the two members.

FIG. 2 illustrates a second embodiment of the present invention, and illustrates only a portion of an image bearing member 6 and a transfer roller 14 in contact therewith. In FIG. 2, the same components as those in the first embodiment are indicated by the same reference numerals. The main body of an image forming apparatus including the transfer roller 14 is the same as that shown in FIG. 4.

The transfer roller 14 is in pressure contact with the image bearing member 6 by means of appropriate known means, such as a pressing spring or the like. A gear 6-*b* provided at an end of the image bearing member 6 meshes with a gear 14-*a* provided at an end of a shaft 12 of the tranfer roller 14 to drive the transfer roller 14. At that time, the circumferential speed of the transfer roller 14 at the transfer position is set to be slightly greater than the circumferential speed of the image bearing member 6 (for example, 101% of the circumferential speed of the image bearing member 6).

In this configuration, an electromagnetic clutch 9 is disposed on the shaft 12 at a position close to the gear 14-*a*.

By turning on the electromagnetic clutch 9, the shaft 12 is connected to the gear 14-*a*, and the transfer roller 14 is driven by the gear 6-*b* present at the driving side. By turning off the electromagnetic clutch 9, the connection between the gear 14-*a* and the shaft 12 is released, and the transfer roller 14 is rotatably driven due to the friction with the surface of the image bearing member 6.

Accordingly, when outputting an image including only characters and lines, a character-image mode is selected, in which the transfer roller 14 at the transfer position is driven at a circumferential speed greater than that of the image bearing member 6 by turning on the electromagnetic clutch 9. When outputting a halftone image, such as a photograph or the like, a halftone-image mode is selected, in which the circumferential speed of the transfer roller 14 at the transfer position is reduced so as to substantially coincide with the circumferential speed of the image bearing member 6 by causing the transfer roller 14 to be driven by the image bearing member 6 by turning off the electromagnetic clutch 9. As a result, the generation of unevenness in the density due to a difference between printing modes is effectively prevented.

As in the first embodiment shown in FIG. 1, switching between the driving operation from the gear 14-*a* and the driven operation from the image bearing member 6 of the transfer roller 14 may be performed by turning on and off the electromagnetic clutch 9 by transmitting a signal for instructing switching between the halftone mode for graphics, a photograph or the like and the character mode from a host computer or by operating a switch provided on the main body of the image forming apparatus in accordance with an image to be output. Since a graphic or photographic output generally has a larger amount of data than a character output, turning on/off of the electromagnetic clutch 9 may be automatically switched by utilizing this fact as in the first embodiment.

Figure 3B:
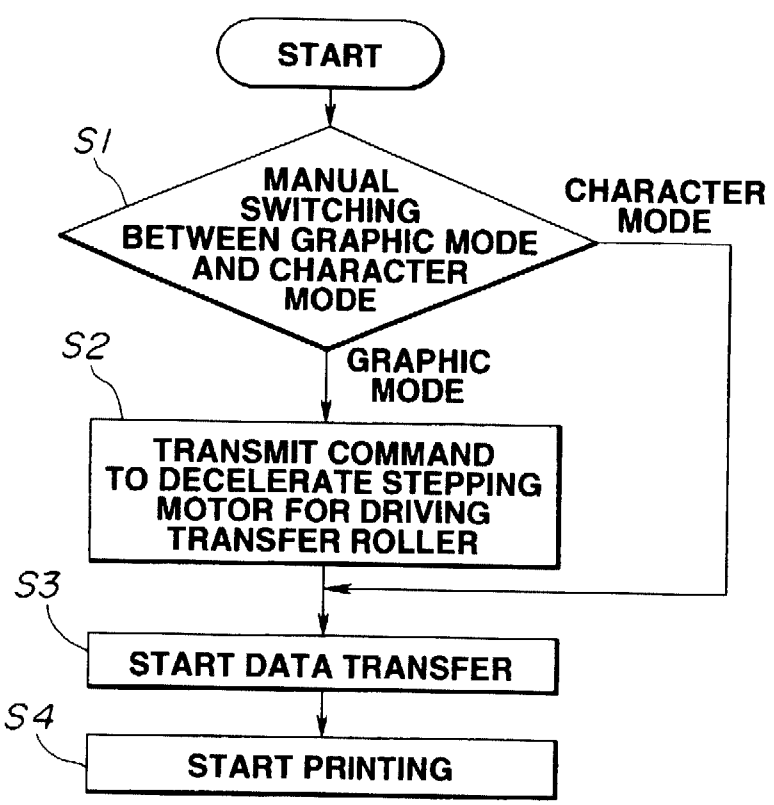
FIGS. 3(*a*) and 3(*b*) are flowcharts illustrating the operations of the apparatus shown in FIG. 1.
Figure 3A:
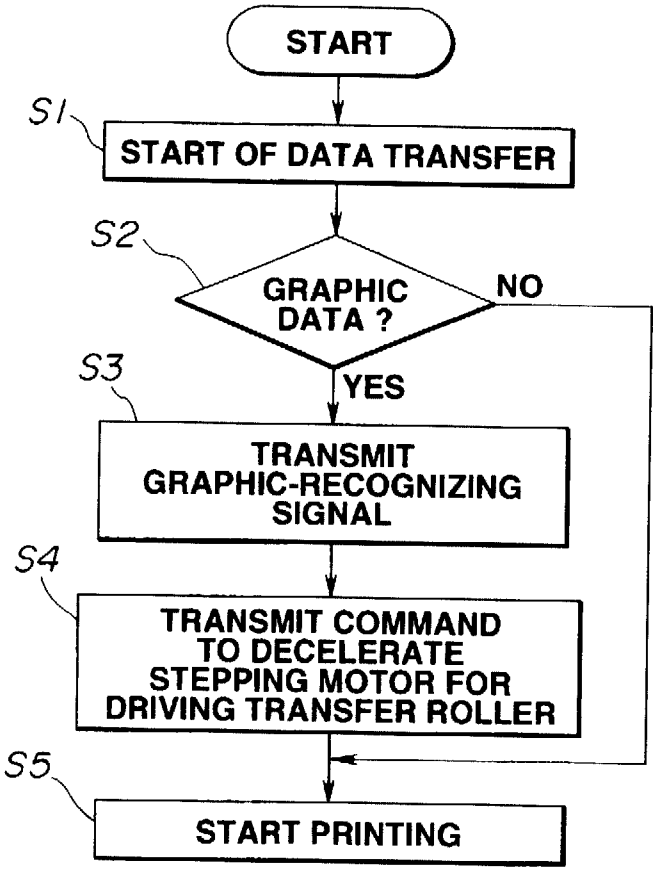

FIGS. 3(*a*) and 3(*b*) are flowcharts illustrating the operations of the apparatus shown in FIG. 1. FIG. 3(*a*) illustrates a case of automatically switching the speed of the stepping motor depending on the image mode. When data is transmitted from a host computer or the main body of the image forming apparatus (step S1), it is then determined whether the data is graphic (photographic) data or character data according to a command in the data (step S2).

When the data is not graphic data, an image forming operation is immediately started (step S5). When the data is graphic data, a signal indicating recognition of graphic data is transmitted to the main body of the apparatus (step S3). Then, a command to decelerate the stepping motor 19 for driving the transfer roller 14 is transmitted (step S4). The process then proceeds to an image forming operation (step S5). At that time, the transfer roller 14 is made to rotate at substantially the same speed as the image bearing member 6.

In the apparatus shown in FIG. 2, in step S4, a command to turn off the electromagnetic clutch 9 provided between the transfer roller 14 and the driving source is transmitted, so that the transfer roller 14 is rotatably driven by the image bearing member 6.

FIG. 3(*b*) illustrates a case of manually switching the speed of the stepping motor 19 using a switch on the image forming apparatus. In step S1, the operator manually switches between the halftone mode for graphics or a photograph and the character mode. In the case of the character mode, data transfer from the main body of the apparatus is started (step S3), and then an image forming operation is started (step S4).

In the case of the halftone mode, a command to decelerate the revolution speed of the stepping motor 19 for driving the transfer roller 14 is transmitted (step S2) to decelerate the stepping motor 19 after starting a printing operation. After starting the printing operation, the transfer roller 14 and the image bearing member 6 are rotated at substantially the same speed.

In the apparatus shown in FIG. 2, in step S2, a command to turn off the electromagnetic clutch 9 provided between the transfer roller 14 and the driving source is transmitted, so that the transfer roller 14 is rotatably driven by the gear 14-*a*.

Then, data transfer from a host computer or the like is started (step S3), and a printing operation is started (step S4).

As described above, according to the present invention, it is possible to prevent a central void in a character or line image, and also to prevent the generation of unevenness in the density of a halftone image. Hence, the present invention is very effective for always obtaining a high-quality image stably irrespective of the characteristics of the image. The individual components shown in outline in the drawings are all well-known in the image forming apparatus arts and their specific construction and operation are not critical to the operation or the best mode for carrying out the invention.

While the present invention has been described with respect to what are presently considered to be the preferred embodiments, it is to be understood that the invention is not limited to the disclosed embodiments. To the contrary, the present invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. An image forming apparatus comprising:

an image bearing member for bearing a toner image;

a transfer member for transferring the tone image from said image bearing member onto a transfer material at a transfer position, said transfer member contacting a surface of the transfer material opposite to a surface facing said image bearing member so as to press the transfer material against said image bearing member; and changing means for changing a speed ratio of a conveying speed of the transfer material at the transfer position to a circumferential speed of said image bearing member, wherein said apparatus is selectable between a first mode of forming a character image on the transfer material and a second mode of forming a halftone image on the transfer material, and said changing means changes the speed ratio in accordance with a mode selected from among the first mode and the second mode.

2. An apparatus according to claim 1, wherein, when the first mode is selected, the speed ratio is greater than when the second mode is selected.

3. An apparatus according to claim 2, wherein, when the first mode is selected, the conveying speed of the transfer material at the transfer position is greater than the circumferential speed of said image bearing member.

4. An apparatus according to claim 2, wherein, when the second mode is selected, the circumferential speed of said image bearing member and the conveying speed of the transfer material at the transfer position are substantially the same.

5. An apparatus according to any one of claims 1 through 4, wherein said transfer member comprises a transfer roller.

6. An apparatus according to claim 5, wherein, when the first mode is selected, a circumferential speed of said transfer roller at the transfer position is greater than when the second mode is selected.

7. An apparatus according to claim 6, wherein, when the first mode is selected, the circumferential speed of said transfer roller at the transfer position is greater than the circumferential speed of said image bearing member.

8. An apparatus according to claim 6, wherein, when the second mode is selected, the circumferential speed of said image bearing member and the circumferential speed of said transfer roller at the transfer position are substantially the same.

9. An apparatus according to claim 6, wherein said changing means is provided independently of a driving source for driving said image bearing member.

10. An apparatus according to claim 6, wherein said changing means comprises a stepping motor for driving said transfer roller.

11. An apparatus according to claim 6, wherein said changing means comprises clutch means provided at a driving transmission path between said transfer roller and said image bearing member for driving said transfer roller.

* * * * *

UNITED STATES PATENT AND TRADEMARK OFFICE

CERTIFICATE OF CORRECTION

PATENT NO. : 5,761,574
DATED : June 2, 1998
INVENTOR(S) : Ken Murooka

It is certified that error appears in the above-identified patent and that said Letters Patent is hereby corrected as shown below: On the title page, Item [56]

U.S. Patent Documents, insert --5,119,129 6/1992 Setani 399/82--; and --5,134,439 7/1992 Zuber 399/82--.
Foreign Patent Documents, insert --61-88278 5/1986 Japan Tanaka--; 6-118786 4/1994 Japan Iwata et al.; and 6-258968 9/1994 Japan Ushio--.

COLUMN 1

Line 10, "apparatus" should read --apparatuses--; and
Line 64, "apparatus" should read --apparatuses--.

COLUMN 2

Line 22, "uneveness" should read --unevenness--;
Line 27, "uneveness" should read --unevenness--; and
Line 42, "trasfer" should read --transfer--.

COLUMN 4

Line 23, "tranfer" should read --transfer--.

Signed and Sealed this

Twenty-ninth Day of June, 1999

*Attest:*

*Attesting Officer*

Q. TODD DICKINSON

*Acting Commissioner of Patents and Trademarks*